US005166695A

United States Patent [19]

Chan et al.

[11] Patent Number: 5,166,695

[45] Date of Patent: Nov. 24, 1992

[54] AUTO-EXTENDING ANTENNA

[75] Inventors: Hiang B. Chan; Her S. Tan, both of Singapore, Singapore

[73] Assignee: Motorola, Inc., Schaumburg, Ill.

[21] Appl. No.: 729,666

[22] Filed: Jul. 15, 1991

[51] Int. Cl.[5] ..... H01Q 1/24

[52] U.S. Cl. ..... 343/702; 343/901

[58] Field of Search ..... 343/702, 715, 900, 901, 343/903

[56] References Cited

U.S. PATENT DOCUMENTS

| | | | |
|---|---|---|---|
| 2,709,220 | 5/1955 | Spector | 343/903 |
| 4,742,360 | 5/1988 | Carolus et al. | 343/715 |
| 4,864,322 | 9/1989 | Yamamoto et al. | 343/715 |
| 4,867,698 | 9/1989 | Griffiths | 343/702 |
| 4,875,053 | 10/1989 | Harada | 343/715 |
| 4,907,007 | 3/1990 | Druecker et al. | 343/903 |
| 4,992,799 | 2/1991 | Garay | 343/702 |

FOREIGN PATENT DOCUMENTS

| | | | |
|---|---|---|---|
| 2406318 | 6/1979 | France | 343/702 |

*Primary Examiner*—Michael C. Wimer
*Assistant Examiner*—Tan Ho
*Attorney, Agent, or Firm*—Daniel K. Nichols; Juliana Agon

[57] ABSTRACT

An auto-extending antenna for a portable radio having a housing which can be closed is inserted into an aperture within the housing. As the housing of a radio using the auto-extending antenna is opened, a toothed wheel attached to the opening portion of the housing is rotated. This toothed wheel is coupled to a second toothed wheel and causes the second toothed wheel to rotate. The second toothed wheel is connected to a first hollow tube which has two opposing slots extending along almost the entire length of the tube. An antenna is inserted into the hollow portion of the first tube, and two opposing nobs attached to the bottom of the antenna protrude through the opposing slots. A second hollow tube fits over the first hollow tube. The inner walls of the second hollow tube have two opposing screw paths winding up its entire length. The nobs extend into the screw paths. The second tube is secured to the housing of the radio. A rotation in the wheel causes the first tube, and therefore the antenna, to rotate within the second tube. As the first hollow tube rotates, the two nobs in the screw paths force the antenna up or down, depending on the direction of the rotation.

14 Claims, 3 Drawing Sheets

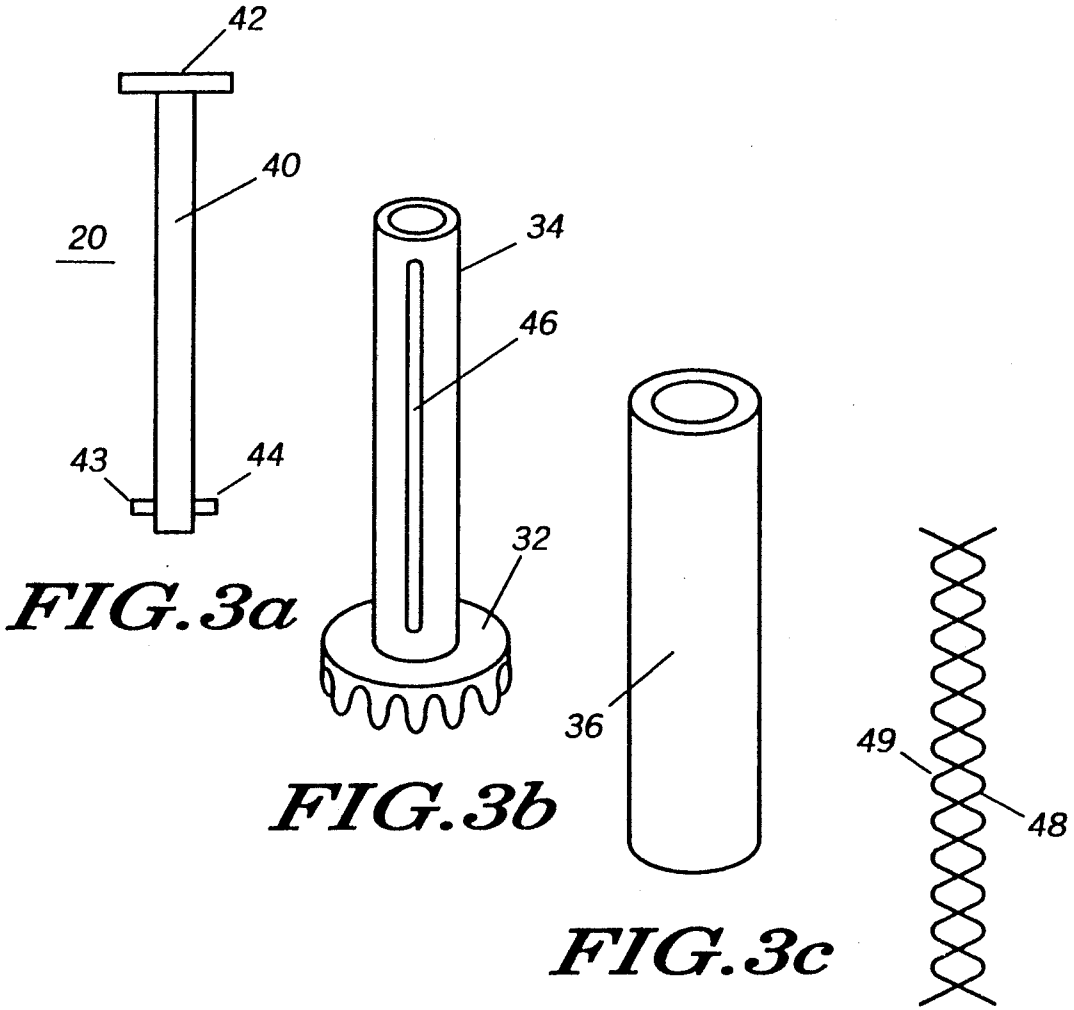
FIG. 3a
FIG. 3b
FIG. 3c
FIG. 3d
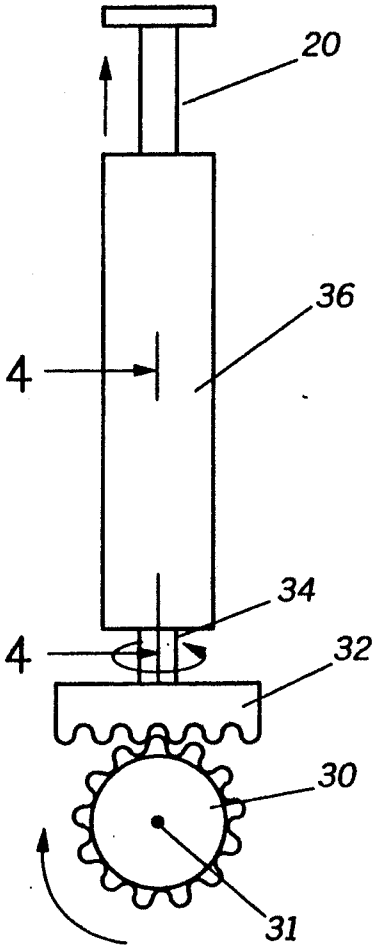
FIG. 2

AUTO-EXTENDING ANTENNA

BACKGROUND OF THE INVENTION

This invention relates, in general, to antennas, and more specifically, to antennas which extend with out manual effort. Such auto-extending antennas may conveniently be used with portable radios, including portable telephones.

One of the many frequently occuring problems which manufacturers of portable communication equipment find is breaking antennas. There are many factors which can be attributed to breaking antennas. One factor is the force by which the user of the equipment pulls the antenna out of the casing. Another factor is the antenna is often twisted as the antenna is pulled out of the radio housing. This twisting may cause fatigue in the antenna after an extended period of time. These factors will continue to cause failure in antennas as long as manual extraction is required. However, to date a practical solution to the manual extraction problem has not been found for portable communication equipment.

Antenna fatigue is only one problem with manually extracting antennas. More and more users of electronic devices desire user-easy equipment where very few steps are required to have a fully operational device. Each time a user of portable communication equipment desires to make or answer a call, he or she must not only turn on the machine and often open a part of the radio housing, but must also pull the antenna out. This not only adds an additional step, but lengthens the time required to operate the equipment.

SUMMARY OF THE INVENTION

The present invention facilitates extending the antenna of a portable radio automatically when the radio housing is opened for operation. The housing of most portable radios are folded, or in some manner closed in order to make the radio smaller when not in use or to protect the radio from the environmental elements.

According to the present invention, as the housing of a radio using the auto-extending antenna is opened, a toothed wheel attached to the opening portion of the housing is rotated. This toothed wheel is coupled to a second toothed wheel and causes the second toothed wheel to rotate. The second toothed wheel is connected to a first hollow tube which has two opposing slots extending along almost the entire length of the tube. An antenna is inserted into the hollow portion of the first tube, and two opposing knobs attached to the bottom of the antenna protrude through the opposing slots. A second hollow tube fits over the first hollow tube. The inner walls of the second hollow tube have two opposing screw paths winding up its entire length. The knobs extend into the screw paths. The second tube is secured to the housing of the radio. A rotation in the wheel causes the first tube, and therefore the antenna, to rotate within the second tube. As the first hollow tube rotates, the two knobs in the screw paths force the antenna up or down, depending on the direction of the rotation.

Objects, features, and advantages of the above summarized present invention will be better understood from the following detailed description taken in conjunction with the accompanying drawings.

BRIEF DESCRIPTION OF THE DRAWING

FIG. 2 is a view of the auto-extending antenna without the housing or accompanying radio according to the present invention.

FIGS. *3a–3d* are views of each of the elements of the auto-extending antenna mechanism excepting the toothed housing wheel.

Figure 4:
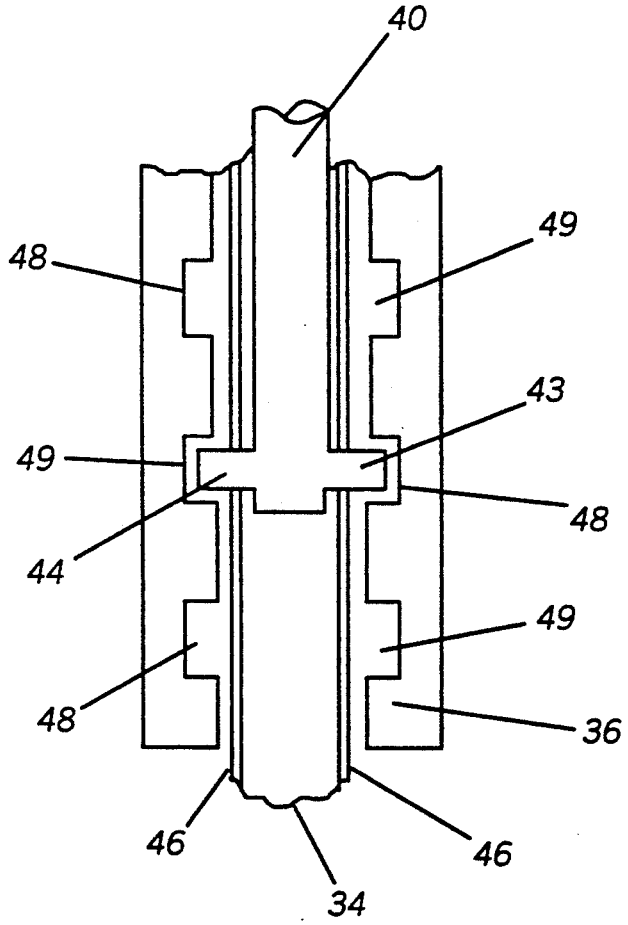

FIG. 4 shows a portion of a cut-away view of the auto-extending antenna of FIG. 2.

DETAILED DESCRIPTION OF THE INVENTION

Figure 1:
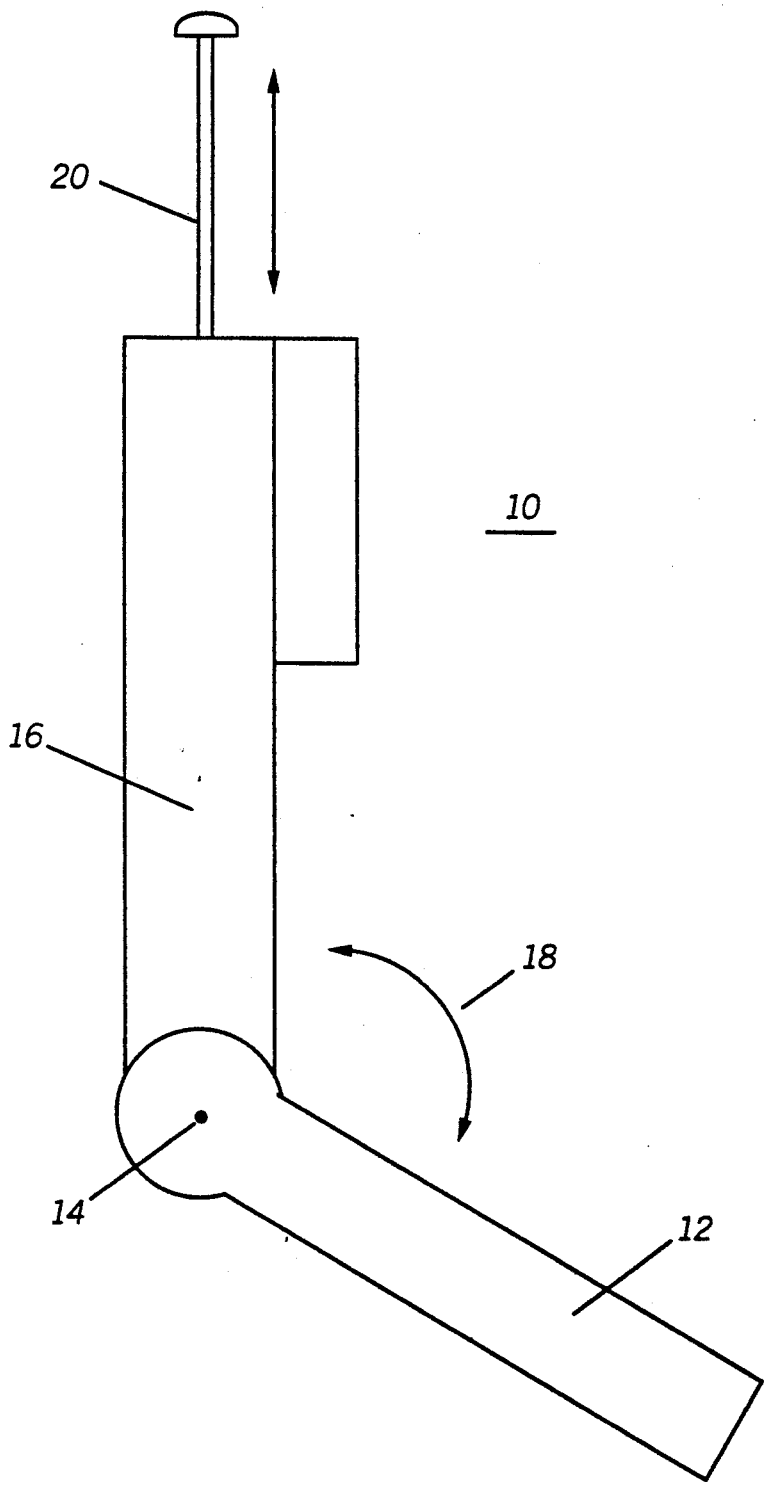
FIG. 1 is a side view of a portable radio having an auto-extending antenna according to the present invention.

FIG. 1 shows one configuration of a portable radio 10. A portable radio such as radio 10 is often designed to allow folding of the radio housing to some extent. This allows the housing to be more compact when the radio is not in use which makes the radio easy to carry. In the preferred embodiment shown in FIG. 1, a bottom portion 12 of radio 10 pivots about point 14 into open and closed positions. Portion 12 is in an open position and radio 10 is ready for use. If portion 12 is rotated back towards body 16 of radio 10 in the counter-clockwise direction of double arrow 18, radio 10 becomes closed.

According to the present invention, when portion 12 is rotated into contact with body 16, thus closing radio 10, an antenna 20 is lowered automatically into body 16. When portion 12 is rotated into the open position shown in FIG. 1, antenna 20 is raised automatically. According to the present invention, antenna 20 and portion 12 are mechanically coupled so that there is a direct correlation between the opening and closing of portion 12 and the extension and retraction of antenna 20.

Because antenna 20 and portion 12 are mechanically coupled, there is no drain on the battery of radio 10 in order to raise the antenna 20. Furthermore, there is no need for the user of radio 10 to manually extend or reinsert antenna 20. Therefore, chances to damage antenna 20 are substantially reduced. The user of radio 10 can instantly use radio 10 as soon as portion 12 is opened. In this manner, the present invention not only reduces the chances of damage to antenna 20, but also makes radio 10 more "user friendly."

The elements shown in FIG. 2 show how portion 12 of FIG. 1 is coupled to antenna 20. In FIG. 2, a first toothed wheel 30 is shown with teeth intermeshed with the teeth of a second toothed wheel 32. Wheel 30 is generally perpendicular to wheel 32. Wheel 30 is secured to portion 12 at point 14 of FIG. 1 (wheel 30 not shown in FIG. 1). As portion 12 rotates about point 14, wheel 30 also rotates about its central axis 31 (FIG. 2) at the same speed and in the same direction. As wheel 30 rotates about axis 31, second toothed wheel 32 is rotated about. One with ordinary skill in the art of mechanical dynamics will recognize that intermeshed toothed wheels such as wheels 30 and 32 are commonly used to transfer circular motion from one body to another.

A hollow tube 34 is secured to second toothed wheel 32. Therefore, as wheel 32 rotates, tube 34 also rotates. Tube 34 is inserted into another hollow tube 36. Tube 36 is secured to body 16 of FIG. 1 and therefore does not rotate. Tube 34 rotates about within tube 36. Antenna 20 is inserted into tube 34.

FIGS. *3a–3d* show the elements of FIG. 2 in their unassembled condition. As shown in FIG. *3a*, antenna 20 in its preferred embodiment is comprised of a slender post 40 having a head 42 secured to one end of post 40 and two opposing knobs 43 and 44 secured to the other end of post 40.

As explained above, tube 34 is secured to second toothed wheel 32 as shown in FIG. 3*b*. Two narrow slots 46 (only one slot shown) extend nearly the length of tube 34. Slots 46 are on opposing sides of tube 34. The width of both slots 46 is slightly larger than the width of knobs 43 and 44 to allow knobs 43 and 44 to protrude through slots 46 when antenna 20 is inserted into tube 34.

Tube 36 (FIG. 3*c*) has two winding and opposing screw paths 48 and 49 extending the length and along the inner walls of tube 36

FIG. 3*d* shows the pattern of paths 48 and 49 in their preferred embodiment. When tube 34 is inserted into tube 36, slots 46 are generally aligned with paths 48 and 49. Knobs 43 and 44 can then extend through slots 46 and into paths 48 and 49 with one knob in each groove.

The cut-away side view 4—4 (from FIG. 2) shown in FIG. 4 shows knobs 43 and 44 extending through slots 46 and into paths 48 and 49.

Referring again to FIGS. 2 and 3, as first toothed wheel 30 rotates second toothed wheel 32, tube 34 rotates about. As tube 34 rotates, knobs 43 and 44 which extend through slots 46 are forced around in a circular fashion. As knobs 43 and 44 are forced in a circular direction, they are forced up (or down depending upon the direction of rotation) along screw paths 48 and 49 of FIG. 3*d*. Each time portion 12 of radio 10 in FIG. 1 is opened or closed, the motion forces knobs 43 and 44 up or down along screw paths 48 and 49. Thus antenna 20 is raised and lowered by the motion of portion 12.

By combining an antenna such as antenna 20 with a slotted tube (tube 34) coupled to a rotating element (portion 12) which causes rotation in the slotted tube and antenna, and coupling the rotating antenna to a stationary screw path, an automatically extending antenna is created which does not require any drain on the radio battery or additional manual operation. This also reduces the chances of breaking the antenna.

Although the present invention has been explained in conjunction with a portable radio, the present invention has many and varied applications which are contemplated within the scope of the present invention.

Thus there has been provided, in accordance with the present invention, an auto-extending antenna that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A portable radio having an auto-extending antenna wherein the radio comprises:

radio housing having a first and a second portion;

said second portion being pivotally connected to said first portion in a manner that allows said second portion to rotate about an axis into open and closed positions with respect to said first portion;

said first portion having an aperture, said aperture having a plurality of grooved screw paths;

an antenna having a plurality of knobs secured to a bottom portion of the antenna;

means for translating circular motion from the second portion to the first portion, the motion generated by rotating the second portion;

a slotted tube having a plurality of slots coupled to said means for translating;

said antenna inserted within said slotted tube with the knobs extruding through the slots, the knobs extending into the grooved screw paths in the aperture of said first portion.

means for twisting the antenna by means of the rotating slotted tube; and means for pushing the antenna up and down as the knobs follow the screw paths while being twisted.

2. The portable radio according to claim 1, wherein said means for pushing the antenna up and down comprises:

said means for translating coupled to said second portion;

a means for moving said antenna in and out of said aperture of said first portion when a circular motion is applied to said means for translating;

said means for moving coupled to said antenna;

said means for translating coupled to said means for moving;

said means for moving coupled within said aperture to said first portion; and said antenna inserted within said means for moving.

3. The portable radio according to claim 2, wherein said means for moving said antenna in and out of said aperture comprises:

first hollow tube;

said first hollow tube secured within said aperture;

said first hollow tube having a plurlity of screw paths grooved into inner walls of said first hollow tube;

second hollow tube coupled to said means for translating;

said second hollow tube having a plurality of opposing slots within walls of said second hollow tube and extending the length of said second hollow tube;

plurality of knobs secured to a bottom end of said antenna;

said antenna inserted into said second hollow tube;

said second hollow tube inserted into said first hollow tube;

said knobs extending through said plurality of opposing slots and into said plurality of screw paths; and said knobs following said screw paths up and down said aperture to force said antenna up and down when circular motion is translated to said slotted tube from said means for translating.

4. The portable radio according to claim 2, wherein said means for translating comprises:

first and second gear wheels;

said first gear wheel secured to said second portion;

said second gear wheel secured to said means for moving; and said first and second gear wheels intermeshed in such a manner that when said first gear wheel is rotated by a rotation of said second portion, said second gear wheel is also rotated to translate the circular motion of said second portion to said means for moving.

5. The portable radio according to claim 4, wherein said first gear wheel is perpendicular to said second gear wheel.

6. The portable radio according to claim 3, wherein said means for translating comprises:
first and second toothed wheels;
said first toothed wheel secured to said second portion;
said second toothed wheel secured to said slotted tube; and
the teeth of said first and second toothed wheels intermeshed in such a manner that when said first toothed wheel is rotated by a rotation of said second portion, said second toothed wheel is also rotated to translate the circular motion of said second portion to said slotted tube.

7. The portable radio according to claim 6, wherein said first toothed wheel is perpendicular to said second toothed wheel.

8. A portable radio having an auto-extending antenna wherein the radio comprises:
a radio housing having a first and a second portion:
said second portion being pivotally connected to said first portion in a manner that allows said second portion to rotate about an axis into open and closed positions with respect to said first portion;
said first portion having an aperture;
an antenna inserted within said aperture of said first portion;
means for extending or retracting said antenna when said second portion is rotated about said axis, wherein said means for extending or retracting comprises:
means for transmitting circular motion from one body to another;
said means for transmitting coupled to said second portion;
a first hollow tube;
said first hollow tube secured within said aperture;
said first hollow tube having a plurality of screw paths grooved into inner walls of said first hollow tube;
a second hollow tube coupled to said means for transmitting;
said second hollow tube having a plurality of opposing slots within walls of said second hollow tube and extending the length of said second hollow tube;
a plurality of knobs secured to a bottom end of said antenna;
said antenna inserted into said second hollow tube;
said second hollow tube inserted into said first hollow tube;
said knobs extending through said plurality of opposing slots and into said plurality of screw paths; and
said knobs following said screw paths up and down said first hollow tube to force said antenna up and down when a circular motion is transmitted to said second hollow tube from said means for transmitting; and
said means for extending coupled to said first and second portions and to said antenna.

9. The portable radio according to claim 8, wherein said means for transmitting comprises:
first and second toothed wheels;
said first toothed wheel secured to said second portion;
said second toothed wheel secured to said second hollow tube; and
the teeth of said first and second toothed wheels intermeshed in such a manner that when said first toothed wheel is rotated by a rotation of said second portion, said second toothed wheel is also rotated to transmit the circular motion of said second portion to said second hollow tube.

10. The portable radio according to claim 9, wherein said first toothed wheel is perpendicular to said second toothed wheel.

11. An auto-extending antenna for a portable radio having a first and second housing portion wherein the second portion is being pivotally connected to the first portion in a manner that allows the second portion to rotate about an axis into open and closed positions with respect to the first portion, the first portion having an aperture, the auto-extending antenna comprising:
antenna;
means for transmitting circular motion from one body to another;
said means for transmitting coupled to said second portion;
a first hollow tube;
said first hollow tube secured within said aperture;
said first hollow tube having a plurality of screw paths grooved into inner walls of said first hollow tube;
a second hollow tube coupled to said means for transmitting;
said second hollow tube having a plurality of opposing slots within walls of said second hollow tube and extending the length of said second hollow tube;
a plurality of knobs secured to a bottom end of said antenna;
said antenna inserted into said second hollow tube;
said second hollow tube inserted into said first hollow tube;
said knobs extending through said plurality of opposing slots and into said plurality of screw paths; and
said knobs following said screw paths up and down said first hollow tube to force said antenna up and down when a circular motion is transmitted to said second hollow tube from said means for transmitting.

12. The auto-extending antenna according to claim 11, wherein said means for transmitting comprises:
first and second toothed wheels;
said first toothed wheel secured to said second portion;
said second toothed wheel secured to said second hollow tube; and
the teeth of said first and second toothed wheels intermeshed in such a manner that when said first toothed wheel is rotated by a rotation of said second portion, said second toothed wheel is also rotated to transmit the circular motion of said second portion to said second hollow tube.

13. The auto-extending antenna according to claim 12, wherein said first toothed wheel is perpendicular to said second toothed wheel.

14. A method of automatically extending an antenna for a portable radio having first and second housing portions wherein the second housing portion is pivotally connected to the first housing portion in a manner that allows the second portion to rotate about an axis into open and closed positions with respect to the first portion, the first portion having an aperture for the antenna, the antenna having a plurality of knobs secured to a bottom portion of the antenna, the antenna being inserted into a slotted tube with the knobs extruding through slots in said slotted tube, the knobs extending into grooved screw paths in the aperture, the method comprising the steps of:

transmitting the circular motion generated by rotating the second portion from the second portion to the slotted tube;

twisting the antenna by means of the rotating slotted tube; and pushing the antenna up and down as the knobs follow the screw paths while being twisted.

* * * * *